US006202905B1

(12) United States Patent
Heide

(10) Patent No.: US 6,202,905 B1
(45) Date of Patent: Mar. 20, 2001

(54) SUIT AND TIE HANGER

(76) Inventor: David C. Heide, 8051 Revell Ct., Orland Park, IL (US) 60462

( * ) Notice: Subject to any disclaimer, the term of this patent is extended or adjusted under 35 U.S.C. 154(b) by 0 days.

(21) Appl. No.: 09/473,089

(22) Filed: Dec. 28, 1999

(51) Int. Cl.[7] ..... A47G 25/40
(52) U.S. Cl. ..... 223/94; 223/88; 223/DIG. 1
(58) Field of Search ..... 223/85, 88, 92, 223/89, 94, DIG. 1

(56) References Cited

U.S. PATENT DOCUMENTS

| | | | | |
|---|---|---|---|---|
| D. 155,957 | | 11/1949 | Woodbury . | |
| D. 301,941 | | 7/1989 | Weckstein et al. . | |
| 1,040,181 | * | 10/1912 | Frank | 223/94 |
| 2,455,478 | | 12/1948 | Grant . | |
| 3,592,343 | | 7/1971 | Swett . | |
| 4,029,212 | * | 6/1977 | Uadiski | 211/113 |
| 4,058,222 | * | 11/1977 | Singer | 211/118 |
| 5,137,191 | | 8/1992 | Blachard et al. . | |
| 5,526,968 | | 6/1996 | Larson . | |
| 5,901,888 | * | 5/1999 | Schnieder et al. | 223/89 |
| 5,934,524 | * | 8/1999 | Gray | 223/85 |

* cited by examiner

*Primary Examiner*—Bibhu Mohanty

(57) ABSTRACT

A suit and tie hanger for more effective organization of suits and ties. The suit and tie hanger includes a hanger body having a central portion and a first and second downwardly sloping end portions, and having a bracket member extending from the central portion and a hook member extending upwardly from the central portion and an elongate horizontal member connected to the first end portion and supported upon the second end portion, and further includes an elongate tie keeper support member which is hingedly connected to the bracket member, and also includes a plurality of rung-like tie keeper members which are spaced apart and extend from the elongate tie keeper support member.

11 Claims, 5 Drawing Sheets

25
21
21
24
20
15
11
16

SUIT AND TIE HANGER

BACKGROUND OF THE INVENTION

1. Field of the Invention

The present invention relates to a hanger for combining a suit and ties and more particularly pertains to a new suit and tie hanger for more effective organization of suits and ties.

2. Description of the Prior Art

The use of a hanger for combining a suit and ties is known in the prior art. More specifically, a hanger for combining a suit and ties heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,455,478; U.S. Pat. No. 5,526,968; U.S. Pat. No. 3,592,343; U.S. Pat. No. 5,137,191; U.S. Pat. No. Des. 301,941; and U.S. Pat. No. Des. 155,957.

While these devices fulfill their respective, particular objectives and requirements, the aforementioned patents do not disclose a new suit and tie hanger. The inventive device includes a hanger body having a central portion and a first and second downwardly sloping end portions, and having a bracket member extending from the central portion and a hook member extending upwardly from the central portion and an elongate horizontal member connected to the first end portion and supported upon the second end portion, and further includes an elongate tie keeper support member which is hingedly connected to the bracket member, and also includes a plurality of rung-like tie keeper members which are spaced apart and extend from the elongate tie keeper support member.

In these respects, the suit and tie hanger according to the present invention substantially departs from the conventional concepts and designs of the prior art, and in so doing provides an apparatus primarily developed for the purpose of more effective organization of suits and ties.

SUMMARY OF THE INVENTION

In view of the foregoing disadvantages inherent in the known types of a hanger for combining a suit and ties now present in the prior art, the present invention provides a new suit and tie hanger construction wherein the same can be utilized for more effective organization of suits and ties.

The general purpose of the present invention, which will be described subsequently in greater detail, is to provide a new suit and tie hanger which has many of the advantages of the hanger for combining a suit and ties mentioned heretofore and many novel features that result in a new suit and tie hanger which is not anticipated, rendered obvious, suggested, or even implied by any of the prior art a hanger for combining a suit and ties, either alone or in any combination thereof.

To attain this, the present invention generally comprises a hanger body having a central portion and a first and second downwardly sloping end portions, and having a bracket member extending from the central portion and a hook member extending upwardly from the central portion and an elongate horizontal member connected to the first end portion and supported upon the second end portion, and further includes an elongate tie keeper support member which is hingedly connected to the bracket member, and also includes a plurality of rung-like tie keeper members which are spaced apart and extend from the elongate tie keeper support member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new suit and tie hanger which has many of the advantages of the hanger for combining a suit and ties mentioned heretofore and many novel features that result in a new suit and tie hanger which is not anticipated, rendered obvious, suggested, or even implied by any of the prior art a hanger for combining a suit and ties, either alone or in any combination thereof.

It is another object of the present invention to provide a new suit and tie hanger which may be easily and efficiently manufactured and marketed.

It is a further object of the present invention to provide a new suit and tie hanger which is of a durable and reliable construction.

An even further object of the present invention is to provide a new suit and tie hanger which is susceptible of a low cost of manufacture with regard to both materials and labor, and which accordingly is then susceptible of low prices of sale to the consuming public, thereby making such suit and tie hanger economically available to the buying public.

Still yet another object of the present invention is to provide a new suit and tie hanger which provides in the apparatuses and methods of the prior art some of the advantages thereof, while simultaneously overcoming some of the disadvantages normally associated therewith.

Still another object of the present invention is to provide a new suit and tie hanger for more effective organization of suits and ties.

Yet another object of the present invention is to provide a new suit and tie hanger which includes a hanger body having a central portion and a first and second downwardly sloping end portions, and having a bracket member extending from the central portion and a hook member extending upwardly from the central portion and an elongate horizontal member connected to the first end portion and supported upon the second end portion, and further includes an elongate tie keeper support member which is hingedly connected to the bracket member, and also includes a plurality of rung-like tie keeper members which are spaced apart and extend from the elongate tie keeper support member.

Still yet another object of the present invention is to provide a new suit and tie hanger that is convenient and extremely easy to use and transport.

Even still another object of the present invention is to provide a new suit and tie hanger that allows the user to remove and store ties on the hanger more easily than any of the prior art.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
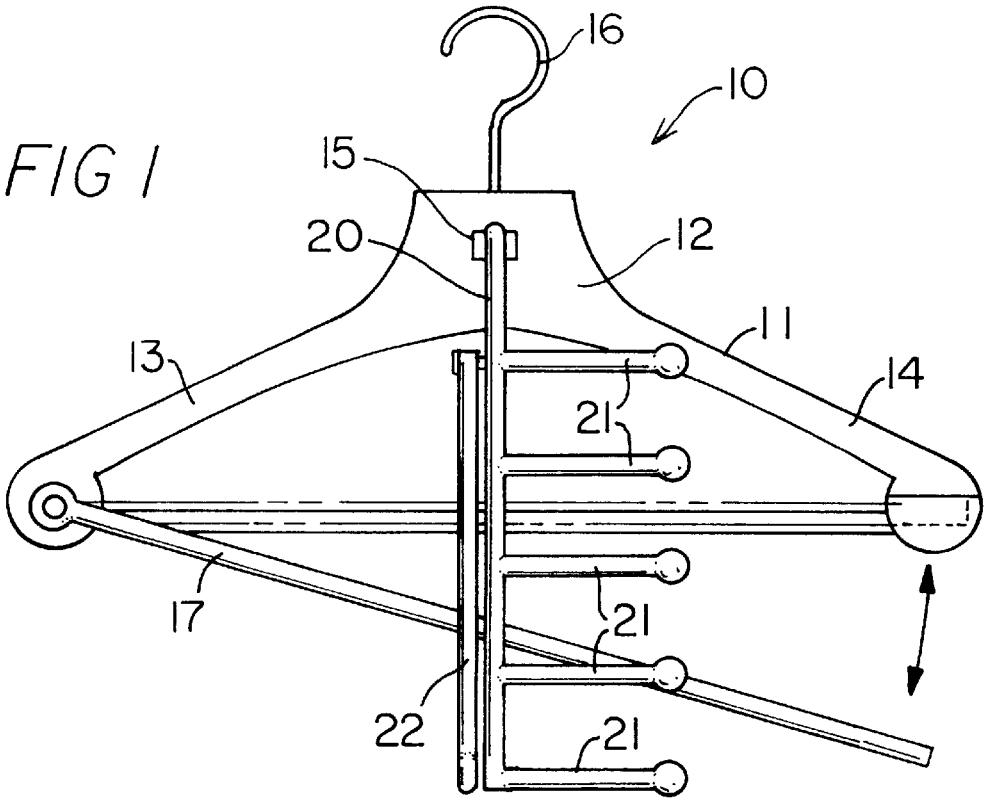
FIG. 1 is a front elevational view of a new suit and tie hanger according to the present invention.
Figure 2:
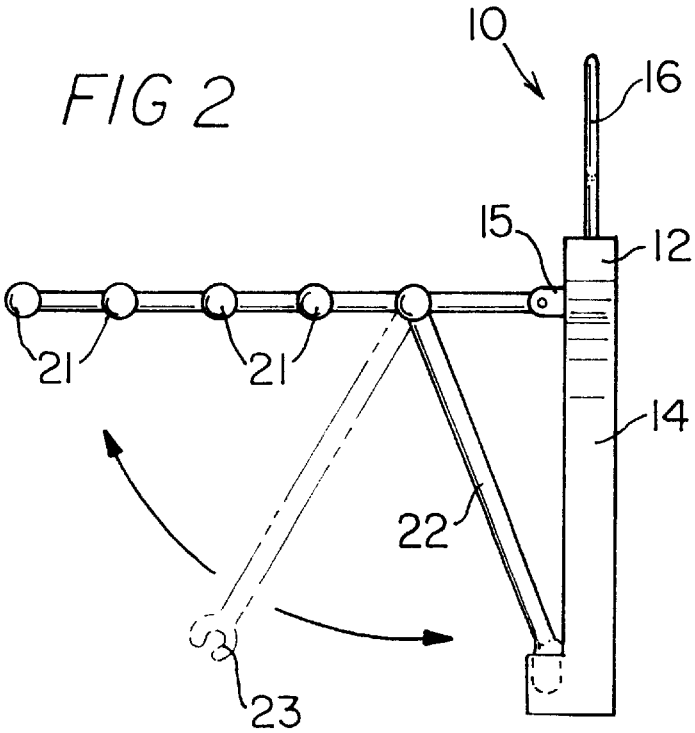
FIG. 2 is a side elevational view of the second embodiment of the present invention.
Figure 3:
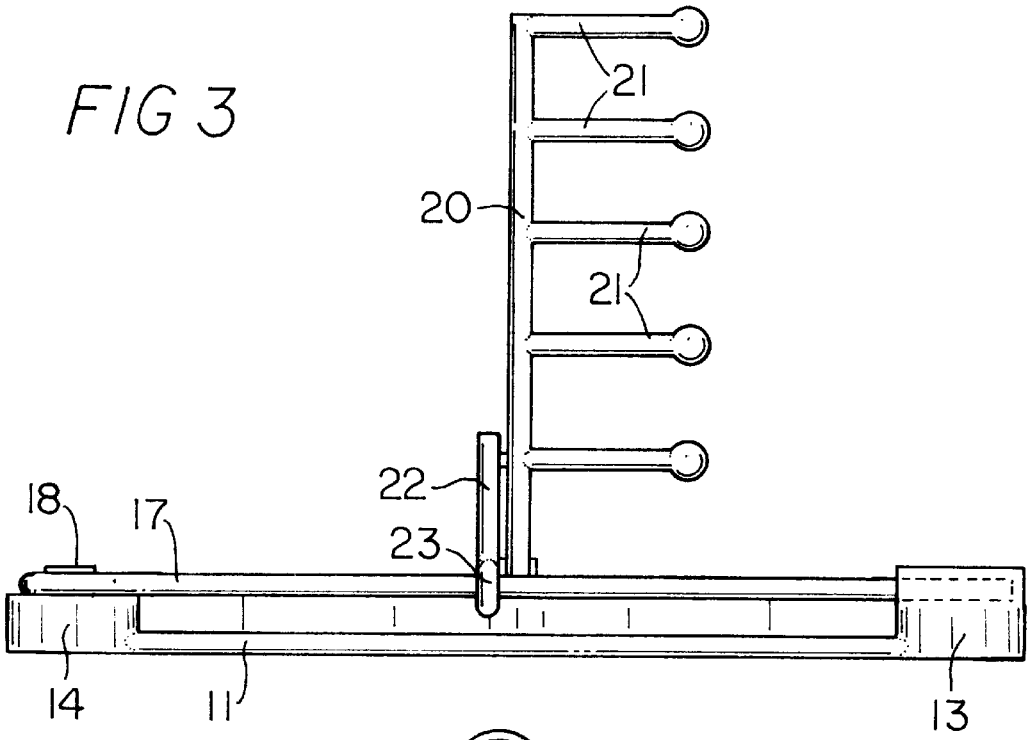
FIG. 3 is a top plan view of the second embodiment of the present invention.
Figure 4:
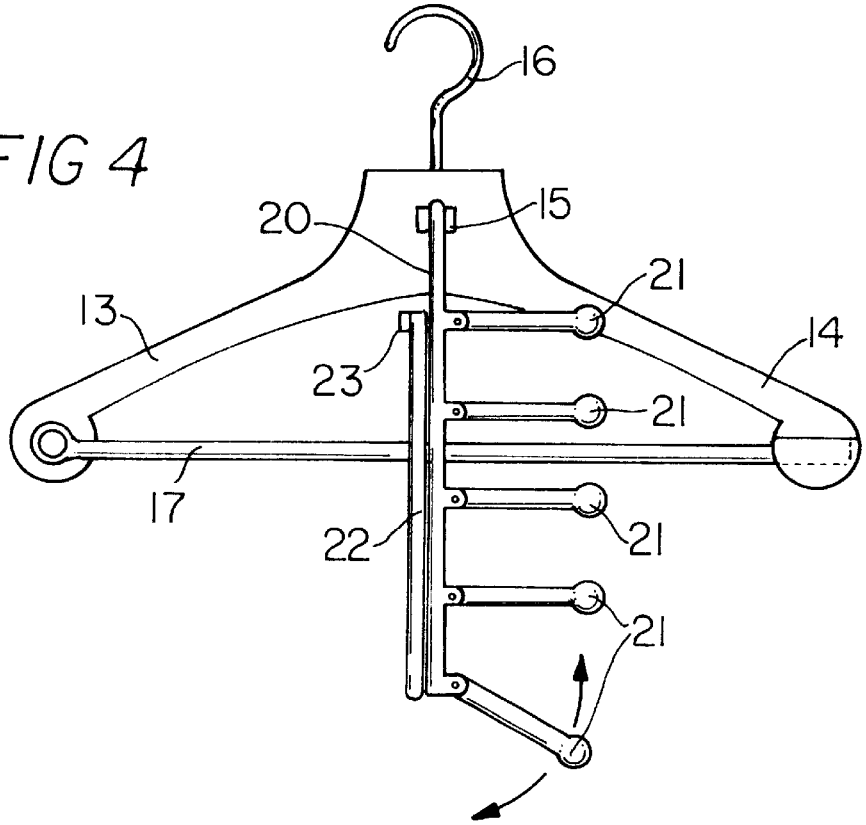
FIG. 4 is a front elevational view of the second embodiment of the present invention.
Figure 5:
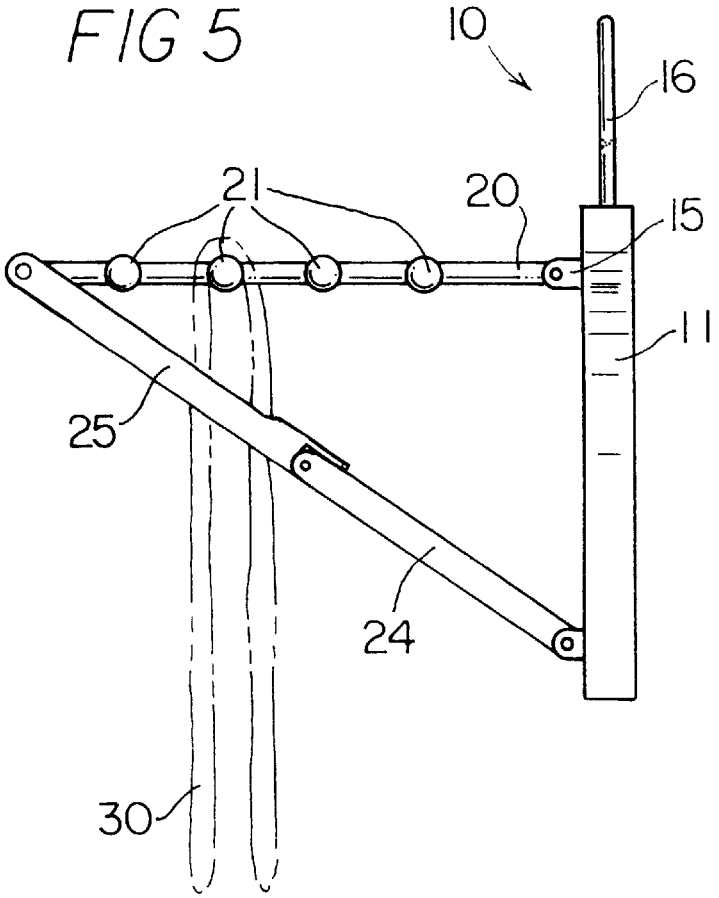
FIG. 5 is a side elevational view of the first embodiment of the present invention.
Figure 6:
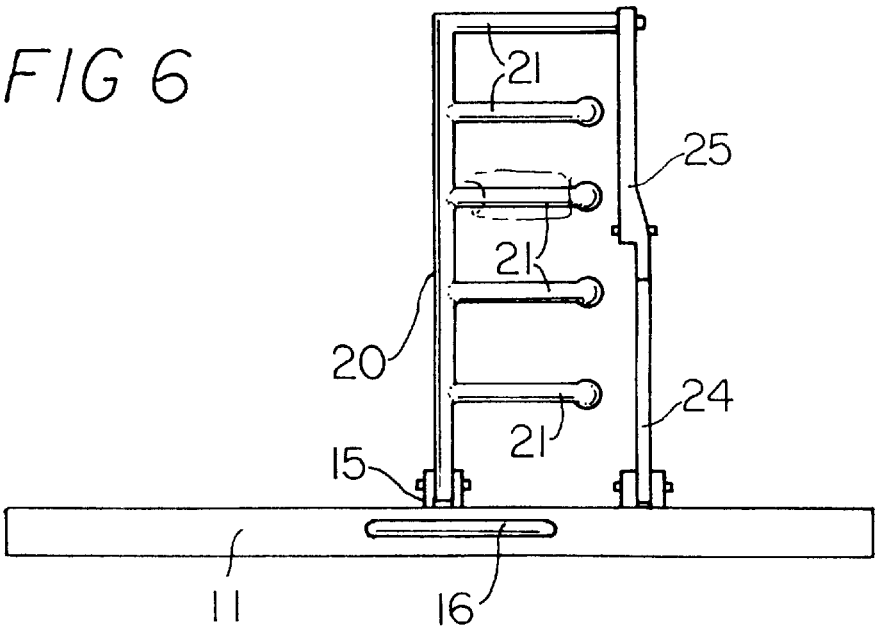
FIG. 6 is a top plan view of the first embodiment of the present invention.
Figure 7:
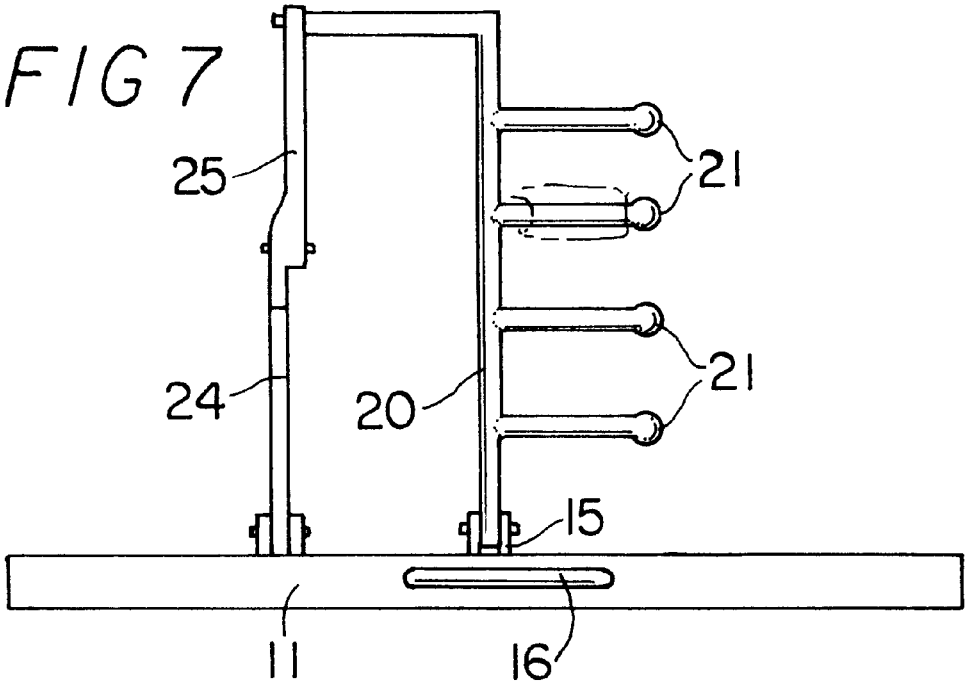
FIG. 7 is a top plan view of another version of the first embodiment of the present invention.
Figure 8:
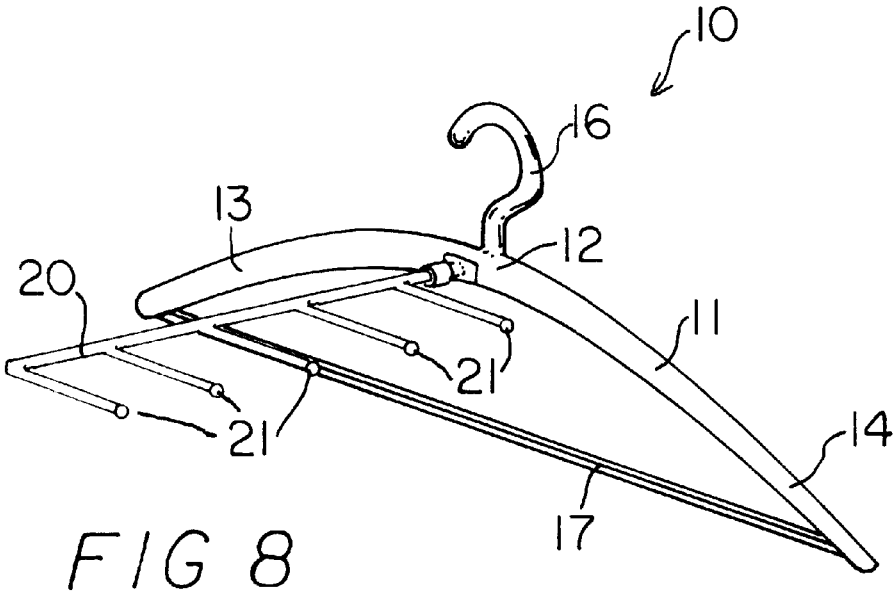
FIG. 8 is a perspective view of the third embodiment of the present invention.
Figure 9:
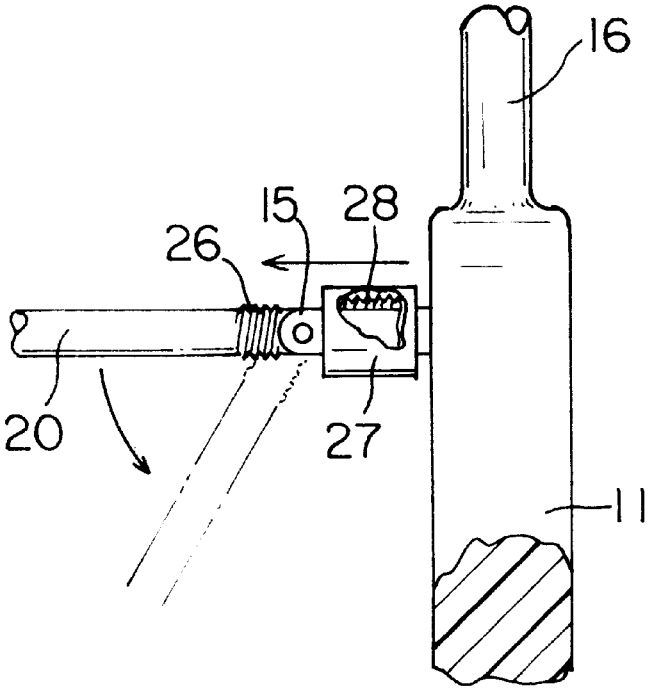
FIG. 9 is a side elevational view of the third embodiment of the present invention.

With reference now to the drawings, and in particular to FIGS. 1 through 9 thereof, a new suit and tie hanger embodying the principles and concepts of the present invention and generally designated by the reference numeral 10 will be described.

As best illustrated in FIGS. 1 through 9, the suit and tie hanger 10 generally comprises a hanger body 11 having a central portion 12 and opposed downwardly sloping first and second elongate end portions 13,14 and further having an elongate horizontal member 17 connected to at least one of the elongate end portions 13,14 and traversing therebetween. The hanger body 11 further includes a hook-like support member 18 securely and conventionally attached to the first elongate end portion 14. The elongate horizontal member 17 has a first end pivotally and conventionally connected to an end of the second elongate end portion 13 and has a second end being removably supported by the hook-like support member 18. The hanger body 11 further includes a bracket member 15 fixedly and conventionally attached to the central portion 12 and extending outwardly therefrom.

A hook member 16 is connected to the central portion 12 of the hanger body 11 and extends upwardly therefrom, and a means for supporting ties upon the hanger body 11 includes an elongate tie keeper support member 17 having a first end pivotally connected to the bracket member 15, and further includes a plurality of rung-like tie keeper members 21 spaced apart and having ends connected to the elongate tie keeper support member 20, and also includes a means for securing the elongate tie keeper support member 20 in a generally perpendicular position relative to the hanger body 11. Each of the rung-like tie keeper members 21 have a first end which is pivotally and conventionally attached to the elongate tie keeper support member 20.

As a first embodiment, the means for securing the elongate tie keeper support member 20 in a generally perpendicular position includes a brace means having a first elongate member 24 having a first end pivotally and conventionally connected to the hanger body 11. The brace means also has a second elongate member 25 having a first end pivotally and lockingly connected to a second end of the first elongate member 24 and further has a second end which is pivotally connected to an end of a rung-like tie keeper member 21 which is securely connected to and extending outwardly from a second end of the elongate tie keeper support member 20.

As a second embodiment, the means for securing the elongate tie keeper support member 20 in a generally perpendicular position includes an elongate brace member 22 having a first end pivotally connected to near the first end of the elongate tie keeper support member 20 with the elongate brace member 22 further having a jaw-like second end 23 which is adapted to removably latch to the elongate horizontal member 17.

As a third embodiment, the means for securing the elongate tie keeper support member 20 in a generally perpendicular position includes a sleeve 27 having a threaded bore 28 therethrough and being slidably mounted upon the bracket member 15. The elongate tie keeper support member 20 is threaded at the first end 26 with the sleeve 27 being partially threadable upon the first end 26 of the elongate tie keeper support member 20.

In use, the suit and tie hanger 10 allows the user to place a pair of pants over the elongate horizontal member and to place a coat or shirt over the elongate end portions 13,14 of the hanger body 11 and to place ties 30 over the rung-like tie keeper members 21. The user can extend and securely lock the elongate tie keeper support member 20 generally perpendicular to the hanger body 11. This allows the user to easily and conveniently remove ties 30 from the rung-like tie keeper members 21 and to place ties 30 over the rung-like tie keeper members 21. After doing so, the user can unlock and pivot the elongate tie keeper support member 20 against the hanger body 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A suit and tie hanger comprising:

a hanger body having a central portion and opposed downwardly sloping first and second elongate end portions and further having an elongate horizontal member connected to at least one of said elongate end portions and traversing therebetween;

a hook member connected to said central portion of said hanger body and extending upwardly therefrom;

a means for supporting ties upon said hanger body;

wherein said hanger body further includes a bracket member fixedly attached to said central portion and extending outwardly therefrom; and wherein said means for supporting ties includes an elongate tie keeper support member having a first end pivotally connected to said bracket member; a plurality of rung-like tie keeper members spaced apart and having ends connected to said elongate tie keeper support member; and a means for securing said elongate tie keeper support member in a generally perpendicular position relative to said hanger body.

2. A suit and tie hanger as described in claim 1, wherein said hanger body further includes a hook-like support member securely attached to said first elongate end portion.

3. A suit and tie hanger as described in claim 2, wherein said elongate horizontal member has a first end pivotally connected to an end of said second elongate end portion and has a second end being removably supported by said hook-like support member.

4. A suit and tie hanger as described in claim 1, wherein said means for securing said elongate tie keeper support member in a generally perpendicular position includes a brace means having a first elongate member having a first end pivotally connected to said hanger body, said brace means also having a second elongate member having a first end pivotally and lockingly connected to a second end of said first elongate member and further having a second end which is pivotally connected to an end of a rung-like tie keeper member which is securely connected to and extending outwardly from a second end of said elongate tie keeper support member.

5. A suit and tie hanger as described in claim 1, wherein said means for securing said elongate tie keeper support member in a generally perpendicular position includes an elongate brace member having a first end pivotally connected to near said first end of said elongate tie keeper support member, said elongate brace member further having a jaw-like second end which is adapted to removably latch to said elongate horizontal member.

6. A suit and tie hanger as described in claim 1, wherein said means for securing said elongate tie keeper support member in a generally perpendicular position includes a sleeve having a threaded bore therethrough and slidably mounted upon said bracket member, said elongate tie keeper support member being threaded at said first end, said sleeve being partially threadable upon said first end of said elongate tie keeper support member.

7. A suit and tie hanger as described in claim 1, wherein each of said rung-like tie keeper members has a first end which is pivotally attached to said elongate tie keeper support member.

8. A suit and tie hanger comprising:

a hanger body having a central portion and opposed downwardly sloping first and second elongate end portions and further having an elongate horizontal member connected to at least one of said elongate end portions and traversing therebetween, said hanger body further including a hook-like support member securely attached to said first elongate end portion, said elongate horizontal member has a first end pivotally connected to an end of said second elongate end portion and has a second end being removably supported by said hook-like support member, said hanger body further including a bracket member fixedly attached to said central portion and extending outwardly therefrom;

a hook member connected to said central portion of said hanger body and extending upwardly therefrom; and a means for supporting ties upon said hanger body including an elongate tie keeper support member having a first end pivotally connected to said bracket member; a plurality of rung-like tie keeper members spaced apart and having ends connected to said elongate tie keeper support member; and a means for securing said elongate tie keeper support member in a generally perpendicular position relative to said hanger body, each of said rung-like tie keeper members having a first end which is pivotally attached to said elongate tie keeper support member.

9. A suit and tie hanger as described in claim 8, wherein said means for securing said elongate tie keeper support member in a generally perpendicular position includes a brace means having a first elongate member having a first end pivotally connected to said hanger body, said brace means also having a second elongate member having a first end pivotally and lockingly connected to a second end of said first elongate member and further having a second end which is pivotally connected to an end of a rung-like tie keeper member which is securely connected to and extending outwardly from a second end of said elongate tie keeper support member.

10. A suit and tie hanger as described in claim 8, wherein said means for securing said elongate tie keeper support member in a generally perpendicular position includes an elongate brace member having a first end pivotally connected to near said first end of said elongate tie keeper support member, said elongate brace member further having a jaw-like second end which is adapted to removably latch to said elongate horizontal member.

11. A suit and tie hanger as described in claim 8, wherein said means for securing said elongate tie keeper support member in a generally perpendicular position includes a sleeve having a threaded bore therethrough and slidably mounted upon said bracket member, said elongate tie keeper support member being threaded at said first end, said sleeve being partially threadable upon said first end of said elongate tie keeper support member.

* * * * *